US006290784B1

(12) United States Patent
Yasuhara et al.

(10) Patent No.: US 6,290,784 B1
(45) Date of Patent: Sep. 18, 2001

(54) HOT ROLLED STEEL SHEET HAVING AN ULTRAFINE GRAIN STRUCTURE AND PROCESS FOR PRODUCING STEEL SHEET

(75) Inventors: Eiko Yasuhara; Akio Tosaka; Osamu Furukimi, all of Chiba (JP)

(73) Assignee: Kawasaki Steel Corporation, Kobe (JP)

( * ) Notice: Subject to any disclaimer, the term of this patent is extended or adjusted under 35 U.S.C. 154(b) by 0 days.

(21) Appl. No.: 09/427,270

(22) Filed: Oct. 26, 1999

(30) Foreign Application Priority Data

Nov. 10, 1998 (JP) ..... 10-319262

(51) Int. Cl.[7] ..... C22C 38/14
(52) U.S. Cl. ..... 148/320; 420/126
(58) Field of Search ..... 148/320; 420/126

(56) References Cited

U.S. PATENT DOCUMENTS

| | | | | |
|---|---|---|---|---|
| Re. 29,240 | * | 5/1977 | Kranenberg | 148/36 |
| 4,466,842 | * | 8/1984 | Yada et al. | 148/12 |
| 5,080,727 | * | 1/1992 | Aihara et al. | 148/11.5 |

FOREIGN PATENT DOCUMENTS

| | | |
|---|---|---|
| 58-123823 | 7/1983 | (JP) . |
| 2-301540 | 12/1990 | (JP) . |
| 5-65564 | 9/1993 | (JP) . |
| 9-87798 | 3/1997 | (JP) . |
| 9-143570 | 6/1997 | (JP) . |
| 10-8138 | 1/1998 | (JP) . |

* cited by examiner

*Primary Examiner*—George Wyszomierski
*Assistant Examiner*—Janelle Combs-Morillo
(74) *Attorney, Agent, or Firm*—Oliff & Berridge, PLC

(57) ABSTRACT

A hot rolled steel sheet comprises ultrafine ferrite grains as a main phase and fine second phase particles. The ferrite grains have an average grain size of not less than 2 $\mu$m but less than 4 $\mu$m. The second phase has an average particle size of not more than 8 $\mu$m and in not less than 80% of the second phase, the spacing of the second phase particle with the closest second phase particle is not less than the second phase particle size. The steel sheet has an ultrafine grain structure, superior mechanical characteristics, reduced anisotropy in its mechanical characteristics and high formability. A process for producing the steel sheet is also disclosed.

10 Claims, 1 Drawing Sheet

HOT ROLLED STEEL SHEET HAVING AN ULTRAFINE GRAIN STRUCTURE AND PROCESS FOR PRODUCING STEEL SHEET

BACKGROUND OF THE INVENTION

1. Field of the Invention

This invention relates to hot rolled steel sheets that are suitably useful for automotive vehicles, household appliances, mechanical structures and constructional materials. More particularly, it relates to such a hot rolled steel sheet which is ultrafine in grain structure as hot-rolled and does not need extra heat treatment, highly ductile and tough, and superior in the strength-elongation balance, and further, is less anisotropic with regard to the mechanical characteristics, particularly ductility.

The term "ultrafine grain structure" as used herein denotes a crystal structure composed of a main phase (usually a ferrite phase), the average crystal grain size (hereinafter called the "average grain size") of which is less than about 4 $\mu$m 2. Description of the Related Art Steel materials to be used for automotive vehicles, household appliances, mechanical structures and constructional materials are required to be superior in mechanical properties, such as strength, formability and toughness. Structural fine grains are advantageous as being capable of improving the above mechanical properties as a whole. Thus, a number of methods have been proposed for producing steel materials with fine grain structures.

As regards high tensile steel, the focus of attention has recently been directed to the development of a high tensile steel sheet which could provide a proper balance between low costs and high functional characteristics. Moreover, a steel sheet for use in automobiles needs superior impact resistance, in addition to high mechanical strength, so as to keep the passengers safe in case of collision of a car. Importantly, therefore, high tensile steel should be brought into a finely grained structure to prevent the same from becoming deteriorated in respect of ductility, toughness and fatigue ratio when steel is made highly tensile.

As means for producing fine grain structures, there are known large-reduction rolling, controlled rolling and controlled cooling.

Large-reduction rolling is disclosed typically by Japanese Unexamined Patent Publication No. 58-123823 and Japanese Examined Patent Publication No. 5-65564, for example. The mechanisms of structural fine graining found in both of these publications contemplate applying large reduction to austenite grains so that the strain-induced $\gamma$ to $\alpha$ a transformation is accelerated. These methods are capable of achieving fine grain structures to some extent, but are defective in that they are difficult to be made feasible by means of a hot strip mill in common use because a hot reduction of not less than 40% is necessary per pass. As another problem, the resultant mechanical properties are caused to be anisotropic because the grains are flattened due to large-reduction rolling, or the absorption of fracture energy is reduced due to grain separation.

An example resulting from use of controlled rolling and controlled cooling is a precipitation strengthened steel sheet containing Nb or Ti. This steel sheet is obtained by being made highly tensile with the utilization of precipitation strengthening by Nb or Ti and by being finish-rolled at low temperature utilizing recrystallization prevention in austenite grains provided from Nb or Ti, resulting in fine ferrite grains by the strain-induced $\gamma$ to $\alpha$ transformation from non-recrystallized deformed austenite grains. However, such a steel sheet has the problem that the mechanical properties are greatly anisotropic. With regard to a steel sheet to be used for automobiles and subjected to press forming, for example, the criticality of formability is determined by the level of characteristics in the least elongated direction of the steel sheet. Thus, a greatly anisotropic steel sheet can never produce the characteristic effects of structural fine grains in some instances. Similar reasoning applies also to mechanical structures; that is, an anisotropic steel sheet causes toughness and fatigue strength to be greatly anisotropic, and both of these mechanical properties are important to such a mechanical structure. Consequently, this often fails to exhibit the characteristics of structural fine grains.

In Japanese Unexamined Patent Publication No. 2-301540, a steel structure is disclosed which is composed chiefly of isotropic ferrite grains having an average grain size of not more than 5 $\mu$m. Such steel structure is made by preparing a starting steel material having ferrite at at least one portion of the steel, by heating the steel material, while adding plastic deformation, to a temperature region not less than the critical point ($Ac_1$ point), or by retaining the steel material in a temperature range of not less than the $Ac_1$ point for a certain time subsequently to the above heating so that the steel material is structurally reverse-transformed in part or wholly into austenite, to provide ultrafine austenite grains, and thereafter by cooling the steel material thus treated. In this publication, the ferrite grains formed from transformed austenite are termed the isotropic ferrite grains to be distinguished from non-isotropic ferrite, such as pearlite, bainite or martensite. However, anisotropy cannot be eliminated even by use of this conventional method.

Recently, structural fine graining has been performed by allowing austenite grains to be extremely fine prior to hot rolling, followed by rolling and by structural fine graining with the use of dynamic recrystallization and controlled cooling. Exemplary methods are disclosed, for example, in Japanese Unexamined Patent Publications Nos. 9-87798, 9-143570 and 10-8138.

Japanese Unexamined Patent Publication No. 9-87798 discloses a method of producing a high-tensile hot-rolled steel sheet containing not less than 75% by volume of polygonal ferrite having an average grain size of less than 10 $\mu$m and 5 to 20% by volume of residual austenite. This method comprises: heating a slab at 950 to 1100° C., the slab containing 1.0 to 2.5% by weight of Mn, or not more than 2.5% by weight of Mn, and 0.05 to 0.30% by weight of Ti, or 0.05 to 0.30% by weight of Ti and not more than 0.30% by weight of Nb; hot-rolling the slab at least twice at a reduction of not less than 20% per pass; hot-rolling the slab at a finish-rolling temperature of not lower than the $Ar_3$ transformation temperature; cooling the hot-rolled steel strip at a cooling speed of not less than 20° C./sec; and coiling the resultant steel strip at 350 to 550° C. to obtain the desired steel sheet.

Japanese Unexamined Patent Publication No. 9-143570 discloses a method of producing a high-tensile hot-rolled steel sheet containing not less than 80% by volume of ferrite having an average grain size of less than 10 $\mu$m. This method comprises: heating steel at 950 to 1100° C., the slab containing either one or both of 0.05 to 0.3% by weight of Ti and not more than 0.10% by weight of Nb; hot-rolling the steel at least twice at a reduction of not less than 20% per pass; hot-rolling the steel at a finish-rolling temperature of not lower than the $Ar_3$ transformation temperature; cooling the hot-rolled steel strip at a cooling speed of not less than 20°

C./sec at from the $Ar_3$ point to 750° C.; retaining the cooled steel strip in a temperature range of lower than 750° C. to 600° C. for 5 to 20 seconds, and once again cooling the hot steel strip to a temperature of not higher than 550° C. at a cooling speed of not less than 20° C./sec; and coiling the resultant steel strip at a temperature of not higher than 550° C. to obtain the desired steel sheet.

Japanese Unexamined Patent Publication No. 10-8138 discloses a method of producing a high-tensile hot-rolled steel sheet containing ferrite and residual austenite. This method comprises: heating a slab at 950 to 1100° C., the slab containing not more than 1.0% by weight of Mn and 0.05 to 0.30% by weight of Ti, or Nb replaced partly or wholly by Ti and in an amount of twice that of Ti; hot-rolling the slab at least twice at a reduction of not less than 20% per pass; hot-rolling the slab at a finish-rolling temperature of not lower than the $Ar_3$ transformation temperature; cooling the hot-rolled steel strip at a cooling speed of not less than 20° C./sec; and coiling the resultant steel strip at 350 to 550° C. to obtain the desired steel sheet.

The techniques disclosed in Japanese Unexamined Patent Publications Nos. 9-87798, 9-143570 and 10-8138 aim principally at providing steel sheets having fine-grained structures. Such a technique gives a steel sheet having an average grain size of approximately 3.6 μm and having improved strength and ductility. However, this steel sheet is not acceptable with respect to the anisotropy of its mechanical characteristics, and particularly formability when it is applied to automobiles, and hence, is required to be much less anisotropic.

Consequently, a need exists for a hot rolled steel sheet having an ultrafine grain structure, reduced anisotropy and high formability.

SUMMARY OF THE INVENTION

To solve the foregoing problems of the conventional art, it is an object of the present invention to provide a hot rolled steel sheet which is easy to produce using an ordinary hot strip mill, ultrafine in grain structure, less anisotropic relative to mechanical characteristics, and particularly ductility, and highly formable.

In order to achieve the above object, the present inventors have conducted intensive researches and have found that the conventional techniques for structural fine graining are directed to fine graining of only a main phase, i.e., ferrite, but no consideration has been given to the distribution of a second phase. In a steel sheet produced by the conventional techniques for structural fine graining, the second phase is distributed in band-like or cluster-like form. Assuming that this distribution of the second phase would make the resultant steel sheet greatly anisotropic in ductility, for example, eventually tending to deteriorate formability such as pressing, or to cause fracture during stretch flanging, the present inventors have come to consider that it would be advantageous to distribute the second phase in fine and insular form.

The present inventors have conducted further research on methods for dispersing the second phase in fine and insular form, in addition to the fine graining of the main phase. The method found by the present inventors is that repeating lighter reduction than in conventional fine graining technique, during hot rolling, in an austenite region (γ) in a low-temperature region of a dynamic recrystallization temperature. More specifically, γ grains are recovered and recrystallized immediately after rolling by means of light reduction in a low-temperature region of a dynamic recrystallization temperature so that the γ grains can be made fine, and ferrite grains formed from γ to α transformation of the γ grains can be decreased to a grain size of not less than 2 μm but less than 4 μm. Simultaneously, second phase particles can be dispersed in fine and insular form and also reduced in aspect ratio. This is taken to indicate that conflicting characteristics of strength, formability and anisotropy can be improved in well balanced manner. Here, a second phase particle denotes a second phase grain or grains forming an isolated accumulation.

The present invention has been made on the basis of the above findings and further studies.

According to one aspect of the present invention, there is provided a hot rolled steel sheet having an ultrafine grain structure, which comprises ferrite as a main phase and a second phase, the ferrite having an average grain size of not less than 2 μm but less than 4 μm, the second phase particle having an average size of not more than 8 μm, and preferably an aspect ratio of not more than 2.0, and in not less than 80% of the second phase, the spacing of the second phase particle is not less than the particle size. The second phase is preferably at least one selected from pearlite, bainite, martensite and retained austenite.

The hot rolled steel sheet of the present invention preferably comprises, by weight percent, more than 0.01 to 0.3% of C, not more than 2.0% of Si, not more than 3.0% of Mn and not more than 0.5% of P, 0.03 to 0.3% of Ti, and the balance being Fe and incidental impurities.

The above hot rolled steel sheet may comprise, by weight percent, more than 0.01 to 0.3% of C, not more than 2.0% of Si, not more than 3.0% of Mn, not more than 0.5% of P, 0.03 to 0.3% of Ti, and at least one of not more than 0.3% of Nb and not more than 0.3% of V, and the balance being Fe and incidental impurities.

The above hot rolled steel sheet may comprise, by weight percent, more than 0.01 to 0.3% of C, not more than 2.0% of Si, not more than 3.0% of Mn, not more than 0.5% of P, 0.03 to 0.3% of Ti, and at least one of not more than 1.0% of Cu, not more than 1.0% of Mo, not more than 1.0% of Ni and not more than 1.0% of Cr, and the balance being Fe and incidental impurities.

The above hot rolled steel sheet may comprise, by weight percent, more than 0.01 to 0.3% of C, not more than 2.0% of Si, not more than 3.0% of Mn, not more than 0.5% of P, 0.03 to 0.3% of Ti, and at least one of Ca, REM and B but in a total of not more than 0.005%, and the balance being Fe and incidental impurities.

The above hot rolled steel sheet may comprise, by weight percent, more than 0.01 to 0.3% of C, not more than 2.0% of Si, not more than 3.0% of Mn, not more than 0.5% of P, 0.03 to 0.3% of Ti, at least one of not more than 0.3% of Nb and not more than 0.3% of V, and at least one of not more than 1.0% of Cu, not more than 1.0% of Mo, not more than 1.0% of Ni and not more than 1.0% of Cr, and the balance being Fe and incidental impurities.

The above hot rolled steel sheet may comprise, by weight percent, more than 0.01 to 0.3% of C, not more than 2.0% of Si, not more than 3.0% of Mn, not more than 0.5% of P, 0.03 to 0.3% of Ti, at least one of not more than 0.3% of Nb and not more than 0.3% of V, and at least one of Ca, REM and B but in a total of not more than 0.005%, and the balance being Fe and incidental impurities.

The above hot rolled steel sheet may comprise, by weight percent, more than 0.01 to 0.3% of C, not more than 2.0% of Si, not more than 3.0% of Mn, not more than 0.5% of P and 0.03 to 0.3% of Ti, at least one of not more than 1.0% of Cu, not more than 1.0% of Mo, not more than 1.0% of Ni and not more than 1.0% of Cr, and at least one of Ca, REM and B but in a total of not more than 0.005%, and the balance being Fe and incidental impurities.

The above hot rolled steel sheet may comprise, by weight percent, more than 0.01 to 0.3% of C, not more than 2.0% of Si, not more than 3.0% of Mn, not more than 0.5% of P and 0.03 to 0.3% of Ti, at least one of not more than 0.3% of Nb and not more than 0.3% of V, at least one of not more than 1.0% of Cu, not more than 1.0% of Mo, not more than 1.0% of Ni and not more than 1.0% of Cr, and at least one of Ca, REM and B but in a total of not more than 0.005%, and the balance being Fe and incidental impurities.

In the present invention, Al can be added as one of the above incidental impurities for deoxidation at a steel making process. The amount of Al is preferably not more than 0.2% by weight.

According to another aspect of the present invention, there is provided a process for producing a hot rolled steel sheet having an ultrafine grain structure, which comprises: re-heating a starting steel material at not higher than 1150° C. or by cooling the same to not higher than 1150° C., the steel material comprising at least two of more than 0.01 to 0.3% of C and 0.03 to 0.3% of Ti, each by weight percent; hot-rolling the steel material at a light reduction in a low-temperature region of a dynamic recrystallization temperature, preferably at a reduction of 4 to 20% per pass, while only the final rolling pass being performed at a reduction of 13 to 30%, and the light reduction in a low-temperature region of a dynamic recrystallization temperature being performed at least for three passes; finish-rolling the rolled steel material at a temperature of not lower than the $Ar_3$ transformation temperature; cooling the finish-rolled steel material starting within 2 seconds, preferably within 1 second, after completion of the hot rolling at a cooling rate of not less than 30° C./sec preferably to 350 to 650° C., and coiling at the temperature.

Here, the low-temperature region of a dynamic recrystallization temperature denotes a temperature range within 80° C., preferably within 60° C., from the lower limit of the dynamic recrystallization temperature.

BRIEF DESCRIPTION OF THE DRAWINGS

FIG. 1A illustrates a high-frequency induction heater which is heating a steel sheet. FIG. 1B illustrates electric heaters which are heating working rolls.

Figure 1A:
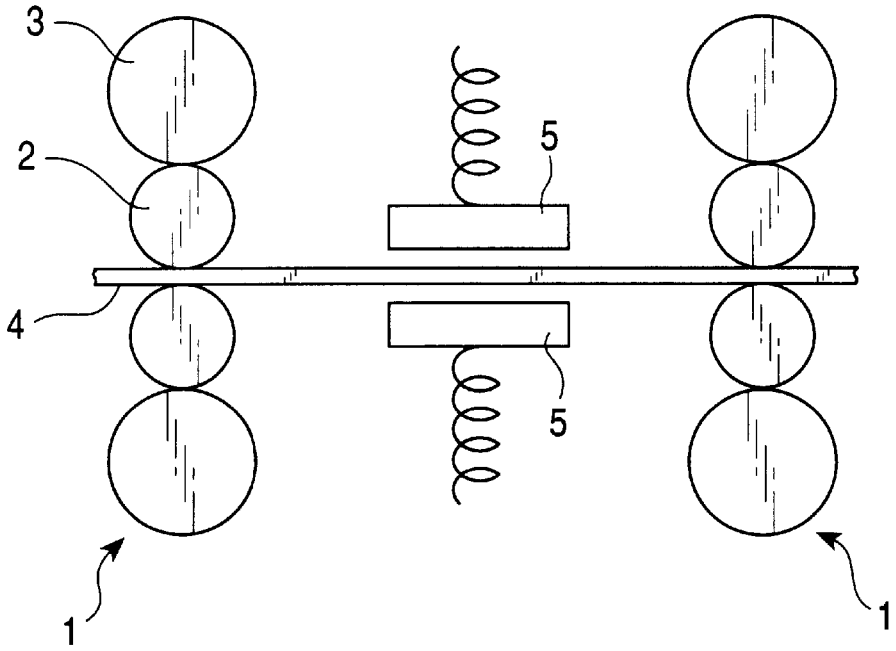
FIGS. 1A and 1B are schematic views showing heating apparatus suitably used in the present invention.

In these figures, roll stands are designated at 1, working rolls at 2, a backup roll at 3, a steel material to be rolled at 4, a high-frequency induction heater unit at 5, and an electric heater unit at 6.

DESCRIPTION OF THE PREFERRED EMBODIMENTS

The hot rolled steel sheet according to the present invention is suitably useful in a wide variety of industrial fields applied as a mild steel sheet, a steel sheet for automotive structures, a high tensile steel sheet for automobiles, a steel sheet for household appliances and a steel sheet for mechanical structures.

The above hot rolled steel sheet is comprised of ferrite as a main phase and second phase particles other than ferrite. The volume ratio of the main phase, ferrite, is preferably at least not less than 50% and preferably not less than 70%.

The main phase of ferrite has a preferred average grain size (diameter) of not less than 2 μm but less than 4 μm. When ferrite grains are made fine, strength can be obtained as desired even with alloy elements added in smaller amounts than in known high tensile steel. Additionally, the characteristics other than strength are less susceptible to deterioration, and subsequent plating is adequate. However, average grain sizes of ferrite of less than 2 μm lead to too high yield strength, bringing about spring back during pressing. Conversely, average grain sizes of not less than 4 μm cause a sharp decline in formability on the whole, and insufficient fine grain strengthening which requires added amounts of alloy elements. Thus, the average grain size of ferrite is preferably not less than 2 μm but less than 4 μm.

The second phase particles preferably have an average particle size (diameter) of not more than 8 μm and an aspect ratio of not more than 2.0. Average particle sizes of more than 8 μm cannot sufficiently improve toughness and ductility. Hence, the average particle size of the second phase particles is preferably not more than 8 μm. Aspect ratios of more than 2.0 are responsible for greatly anisotropic mechanical characteristics, particularly adverse in directions of rolling at 45° and 90°. Hence, the aspect ratio of the second phase particles is preferably not more than 2.0.

In the present invention, the average grain size of the ferrite grains and the average particle size of the second phase particles are defined, as is in common practice, as an average grain size and an average particle size determined cross-sectionally in a direction of rolling, i.e., cross-sectionally in parallel to a direction of rolling. The aspect ratio of the second phase particles means the ratio of longer diameter to shorter diameter of a second phase particle. The longer diameter is generally in a direction of rolling, while the shorter diameter is generally in a direction of thickness.

The grain size and particle size used herein are preferably the nominal sizes so expressed that a particle segment is measured by the linear shearing method of JIS G552 and multiplied by 1.128. In this instance, etching of grain boundaries is preferably conducted for about 15 seconds by use of about 5% nitric acid in alcohol. The aspect ratio may also be obtained by determining the particle sizes in two directions of longer and shorter diameters.

The average grain size and average particle size are determined by observing the steel sheet structure, in the above cross section but devoid of a thickness portion of 1/10 from the steel sheet surface, at 5 or more fields, at a magnification of 400 to 1000 and using an optical microscope or a scanning electronic microscope (SEM), and by averaging each of the grain size and the particle size obtained by the above linear shearing method.

In the hot rolled steel sheet of the present invention, in not less than 80% of the second phase, the spacing of the second phase particle is not less than the second phase particle size (or not less than twice the particle radius). That is, the second phase particles are distributed in insular form, but not in band-like or cluster-like form. If the ratio is less than 80%, the resultant mechanical characteristics are greatly anisotropic so that uniform deformation does not occur during forming, causing a necked or creased surface.

The spacing between the second phase particles is defined by the length of a portion in which a line extending between the centers of two adjacent second phase particles crosses across the main phase. The centers of the two second phase particles may be approximately positioned. In practice, the spacing can be measured directly from, or by imaging of, a photograph taken by an optical microscope or a scanning electronic microscope (SEM). In the case of image treatment, the spacing may be determined by measuring the distance between the centers of the two second phase particles, and by subtracting the radius of each second phase particle from the above distance. Image treatment may preferably be performed by a two-value method in which the second phase particles are monochromatically discriminated from foreign matter.

When the spacing thus measured is not less than the average particle size of second phase particles and when the area of the second phase having such spacing is not less than 80% than that of the overall second phase, it is regarded that the spacing of the second phase particle is not less than the particle size in not less than 80% of the second phase, and that the second phase particles are distributed in insular form.

In the present invention, the second phase preferably comprises of at least one of pearlite, bainite, martensite and retained austenite. Here, although carbides, nitrides and sulfides are usually present in some amounts, they affect as inclusions except for a cementite phase and are not included in the second phase.

The volume ratio of the second phase particles is preferably in the range of 3 to 30%. High volume ratios make strength of the steel sheets easily obtainable at a desirable level, but volume ratios of more than 30% are responsible for poor mechanical characteristics, particularly for unacceptable ductility.

Suitable chemical compositions for the hot rolled steel sheet of the present invention are described below. Unless otherwise noted, the compositions are expressed by weight percent.

C: more than 0.01 to 0.3%

C is an inexpensive reinforcing component and is contained in amounts sufficient to satisfy the predetermined desired strength of a steel sheet. An amount of C of not more than 0.01% leads to coarse grains, failing to provide ferrite having an average grain size of less than 4 $\mu$m according to preferred embodiments of the present invention. An amount of C of more than 0.3% causes deteriorated formability and weldability. Thus, the content of C is preferably in the range of more than 0.01 to 0.3% and more preferably of 0.05 to 0.2%.

Si: not more than 2.0%

Si is effective as a solid solution strengthening component to improve the strength-elongation balance and to enhance strength. Further, Si prevents ferrite formation and gives a structure having a desirable volume ratio of the second phase. However, an excessive addition of Si adversely affects ductility and surface properties. Thus, the content of Si is preferably not more than 2.0%, more preferably in the range of 0.01 to 1.0%, and still more preferably of 0.03 to 1.0%.

Mn: not more than 3.0%

Mn reduces the $Ar_3$ transformation temperature and hence makes grains fine. Moreover, Mn permits the second phase to be martensite and retained austenite and hence enhances the strength-ductility balance and the strength-fatigue strength balance. In addition, Mn converts harmful dissolved S to harmless MnS. Excessive addition causes rigid steel, thereby deteriorating the strength-ductility balance. Thus, the content of Mn is preferably not more than 3.0%, more preferably not less than 0.05%, and still more preferably in the range of 0.5 to 2.0%.

P: not more than 0.5%

P is useful as a reinforcing component and may be added in amounts sufficient to satisfy the desired strength of a steel sheet. Excessive addition segregates P in grain boundaries with consequent brittleness. Thus, the content of P is preferably not more than 0.5%, and more preferably in the range of 0.001 to 0.2%.

Ti: 0.03 to 0.3%

Ti precipitates as TiC and makes initial austenite grains fine at a heating stage of hot rolling and induces dynamic recrystallization at subsequent hot-rolling stages. To this end, contents of at least not less than 0.03% are necessary. For Ti additions greater than 0.3%, the desired advantages are not substantially improved. Thus, the content of Ti is preferably in the range of 0.03 to 0.3%, and more preferably of 0.05 to 0.20%.

At least one of Nb: not more than 0.3%, and V: not more than 0.3%

Both Nb and V form carbides and nitrides and make initial austenite grains fine at a heating stage of hot rolling. When used arbitrarily in combination with Ti, Nb and V act to effectively induce dynamic recrystallization. In amounts of more than 0.3%, the desired advantages are not substantially improved. Thus, the content of each of Nb and V is preferably not more than 0.3%. Nb and V are added preferably in amounts of more than 0.001%.

At least one of Cu: not more than 1.0%, Mo: not more than 1.0%, Ni: not more than 1.0% and Cr: not more than 1.0%

Cu, Mo, Ni and Cr are arbitrarily added as reinforcing components. Excessive addition deteriorates the strength-ductility balance. Thus, the amount of each of Cu, Mo, Ni and Cr added is preferably not more than 1.0%. To obtain the above-stated advantages, these elements are added preferably in amounts of at least 0.01%.

At least one of Ca, REM and B but in a total amount of not more than 0.005%

Ca, REM and B control the shape of sulfides and enhance the strength in grain boundaries with improved formability. They may be added where desired. Excessive addition adversely affects cleanability and recrystallizability. Thus, the contents of Ca, REM and B are preferably not more than 0.005% in total.

In the hot rolled steel sheet of the present invention, the balance other than the above components is Fe and incidental impurities.

Al may be added when needed for deoxidation. The content of Al is preferably not more than 0.2% and more preferably not more than 0.05%.

The process for producing the hot rolled steel sheet according to the present invention is described below.

Molten steel prepared to have a specified composition is formed, by ingot making and slabbing, or by continuous casting, to a starting steel material (slab) to be rolled. This steel material is hot-rolled to provide a hot rolled steel sheet.

Hot rolling used herein may be re-heating rolling in which the steel material is re-heated after being cooled, direct charge rolling or hot charge rolling. Alternatively, a thin slab continuous rolling method may be used in which a continuously cast slab is directly hot-rolled. In the case of re-heating, heating is preferably conducted at not higher than 1150° C. to make initial austenite grains fine. Also, in the case of direct charge rolling or hot charge rolling, rolling is preferably initiated after cooling the steel material to not higher than 1150° C. so as to promote dynamic recrystallization. Because the finish rolling temperature is set in the austenite region, the re-heating temperature and direct charge rolling-initiating temperature are preferably not less than 800° C.

While the steel material is being hot-rolled at the above temperatures, reduction is preferably repeated at least for three passes in a low-temperature region of the dynamic recrystallization temperature range. By the repetition of reduction in a low-temperature region of a dynamic recrystallization temperature range, the austenite grains are made fine. As the dynamic recrystallization occurs repeatedly, fine graining of austenite is facilitated. Thus, reduction is preferably performed at least for three consecutive passes. Less than three passes fails to obtain sufficient fine graining of austenite, making it difficult to provide ferrite grains having an average grain size of less than 4 $\mu$m. Too many passes can lead to extreme fine graining, resulting in a grain size of less than 2 $\mu$m. Thus, the three or four passes is typically suitable.

The hot reduction in a low-temperature region of a dynamic recrystallization temperature is not particularly restricted if dynamic recrystallization occurs. The reduction is preferably in the range of 4 to 20% per pass, except for the final rolling pass in a low-temperature region of the dynamic recrystallization temperature. Reductions of less than 4% do not give dynamic recrystallization, and conversely, reductions of more than 20% cause greatly anisotropic mechanical characteristics. In the final rolling pass in the low temperature range of dynamic recrystallization, the hot reduction is preferably in the range of 13 to 30% to make the second phase fine. Reductions of less than 13% fail to provide a sufficiently fine second phase. Reductions of more than 30% produce no better results, exerting high load on the rolling apparatus, and the resultant mechanical characteristics are greatly anisotropic. Accordingly, the reduction is more preferably in the range of 20 to 30%.

The dynamic recrystallization temperature range is measured in advance from the relationship between strain and stress by simulation of rolling conditions. The simulation and measurement of steel is carried out using a measuring machine in which temperature and strain are individually controlled (for example, "Forming Formaster" manufactured by Fuji Denpa Koki Co.).

More specifically, steel having a certain composition, for example, is heated and compressed at a given temperature and at a given strain rate, whereby a true strain-true stress curve is obtained. If this curve shows a peak at which stress becomes maximum at a certain amount of strain, this indicates that dynamic recrystallization has occurred. By varying the heating temperature, forming temperature and strain speed, a temperature region can be specified in which dynamic recrystallization occurs under predetermined hot-rolling conditions. For measurement, the heating temperature is set to be the slab heating temperature to be effected (for example, about 1000° C.), and compression may be carried out at a ratio of 5 to 70%, at each temperature in the range of 800 to 1100° C. and at a strain speed of about 0.01/sec to 10/sec according to the rolling conditions used.

The dynamic recrystallization temperature is variable with the steel composition, heating temperature, hot reduction and pass schedule used. It has been suggested that the dynamic recrystallization temperature is present usually in a temperature zone of 250 to 100° C. in a temperature region of 850 to 1100° C., provided that there is the presence of a temperature zone of a dynamic recrystallization temperature. However, the temperature range, or the presence, of dynamic recrystallization in Ti-containing steel has been substantially unknown to date. The temperature zone in a temperature range of dynamic recrystallization is broader as the hot reduction per pass is higher, or the heating temperature is lower. Rolling in a dynamic recrystallization region contributes more or less to fine graining and hence, it is not imposed to prohibit rolling in a high-temperature region of a dynamic recrystallization temperature. With structural fine graining, however, rolling in a low-temperature region in a dynamic recrystallization temperature is advantageous because transformation sites of $\gamma$ to $\alpha$ transformation are markedly abundant.

In the present invention, therefore, the above-specified rolling conditions are used under which rolling is performed in a dynamic recrystallization temperature region, particularly in a low-temperature region of a dynamic recrystallization temperature. That is, in order to promote fine graining of austenite, hot reduction is preferably performed for three or more passes, as stated above, at a temperature of from the lower limit of temperature of dynamic recrystallization plus 80° C., preferably the lower limit of a dynamic recrystallization temperature plus 60° C., to the lower limit of a dynamic recrystallization temperature.

Figure 1B:
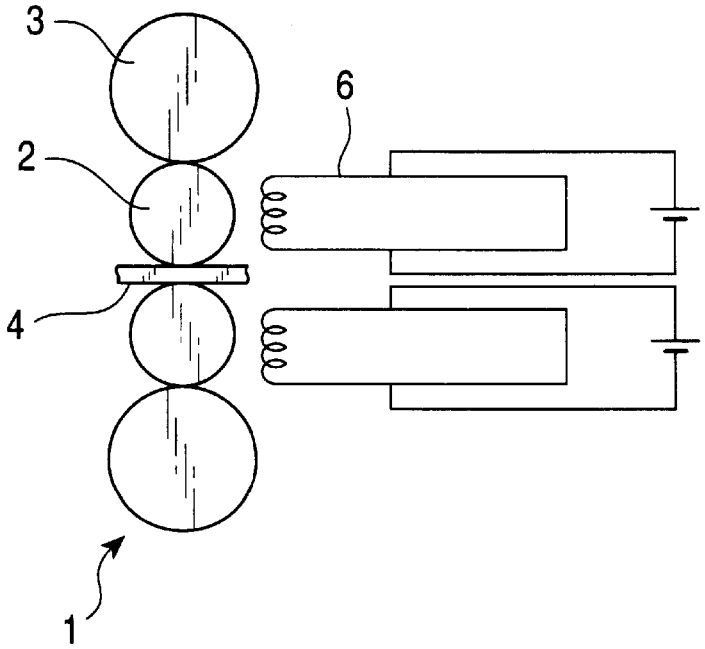

To ensure the number of cycles of rolling in the low-temperature region of the dynamic recrystallization temperature and to prevent the temperature of the steel material from declining during rolling, a heater is preferably disposed between rolling stands. The phrase "between rolling stands" means "between rolling stands or between rolling apparatuses" in a rolling mill. The heater is preferably arranged at a position susceptible to an extreme decline in temperature. FIGS. 1A and 1B illustrate examples of the heater. The heater shown in FIG. 1A is a high-frequency induction heater unit designed to apply alternating magnetic fields to a steel material to be rolled, thereby generating an induction current to heat the steel material. In place of the high-frequency heater, an electric heater unit may be used as shown in FIG. 1B, by which working rolls are heated. The electric heater unit can be arranged to heat the steel material directly.

In hot rolling, hot reduction may of course be conducted while lubrication is being applied. Lubrication rolling is advantageous as it is capable of lessening the load carried on the rolls. Lubrication rolling need not be effected with respect to all of the stands.

In the present invention, no restriction is placed on rolling conditions except for rolling in a low-temperature region of a dynamic recrystallization temperature. However, the finish rolling temperature is not lower than the $Ar_3$ transformation temperature. Finish rolling temperatures of lower than the $Ar_3$ point make the resulting steel sheet less ductile and less tough, causing greatly anisotropic mechanical characteristics.

In the hot rolled steel sheet produced by hot rolling under the above conditions, austenite grains are substantially regular grains. Cooling immediately after completion of the hot rolling gives a number of transformation nuclei of $\gamma$ to $\alpha$ transformation, preventing ferrite grains from growth and providing structural fine graining. Hence, desirably, cooling is initiated within 2 seconds, preferably within 1 second, after completion of the hot rolling. A lapse of 2 seconds is responsible for a large grain growth.

Furthermore, the cooling rate is preferably not less than 30° C./sec. Cooling rates of less than 30° C./sec cause ferrite grain growth, failing to obtain fine graining and making it difficult to distribute the second phase in fine and insular form.

The hot rolled steel sheet is cooled preferably to a temperature range of 350 to 600° C. at a cooling rate of not less than 30° C./sec. And the cooled steel sheet is preferably immediately coiled. The coiling temperature is, thus, preferably in the range of 350 to 600° C. The coiling temperature and cooling rate after coiling are not restricted, and may be determined considering the type of the steel sheet.

EXAMPLES

Molten steel having compositions as shown in Table 1 was continuously cast to slabs (steel materials to be rolled). The slabs were subjected to heating, hot rolling and cooling under the different conditions shown in Table 2, to obtain hot rolled steel sheets (section thickness: 1.8 to 3.5 mm). Steel sheet no. 3 was lubrication-rolled. Steel sheet no. 9 was a conventional example in which structural fine graining was conducted by reverse transformation by cooling the steel material to 600° C., by re-heating to 850° C., and subsequently by hot-rolling. Steel sheet no. 21 was produced by controlled rolling in which large reductions were conducted in a non-recrystallization region of austenite.

The steel sheets were analyzed with respect to their structures and mechanical characteristics with the results shown in TABLE 3.

Each of the steel sheet structures was observed in a cross section of the steel sheet, which was sheared in a rolling direction, with the use of an optical microscope or an electronic microscope, so as to measure the volume ratio of ferrite, the grain size of ferrite and the particle size of second phase particles, and the aspect ratio of the second phase particles and the distribution of the second phase particles. Further measurement was made on the spacing of the second phase particles situated in closest proximity to each other. Thus, the ratio of the second phase in the particles, the spacing of which with the closest particle being not less than the particle size, to the total second phase was determined. The ratio shows the distribution of the second phase particles.

The steel sheet structure was analyzed under the suitable conditions described above and from the measurement results by optical microscopy. The spacing of the second phase particles present in closest proximity to each other was determined by measuring the length across the ferrite phase by image treatment based on a two-value method. An electronic microscope was used chiefly for examination of the phases.

The mechanical characteristics were determined by measuring the tensile characteristics (yield strength, YS; tensile strength, TS; and elongation, El) of the steel sheet in the direction of rolling, in a direction at a normal angle to the rolling direction, and in a direction at an angle of 45° relative to the rolling direction. JIS No. 5 specimens were used. From the results of elongation measurement, the anisotropy ΔEl of the steel sheet relative to elongation was calculated which was expressed as $\Delta El = \frac{1}{2} \cdot (El_0 + El_{90}) - El_{45}$. Here, $El_0$ denotes an elongation in a direction of rolling, $El_{90}$ denotes an elongation in a direction at normal angle to the rolling direction, and $El_{45}$ denotes an elongation in a direction at 45° relative to the rolling direction.

Moreover, the ductility-brittleness transition temperature vTrs (° C.) was examined by use of a 2 mm-V notch specimen prepared from the steel sheet as hot-rolled. The results obtained are shown in TABLE 3.

TABLE 1

| Steel | Chemical Compositions (wt %) | | | | | | | | $Ar_3$ | |
|---|---|---|---|---|---|---|---|---|---|---|
| No. | C | Si | Mn | P | S | Ti | Al | Other elements | (° C.) | Remarks |
| A | 0.11 | 0.8 | 1.8 | 0.011 | 0.003 | 0.25 | 0.020 | | 760 | Present Invention |
| B | 0.14 | 0.5 | 1.3 | 0.011 | 0.003 | 0.11 | 0.022 | Nb: 0.05 | 780 | Present Invention |
| C | 0.08 | 0.6 | 2.0 | 0.010 | 0.002 | 0.19 | 0.021 | V: 0.04, Mo: 0.03 | 820 | Present Invention |
| D | 0.12 | 0.7 | 1.0 | 0.012 | 0.004 | 0.15 | 0.020 | Cr: 0.04, REM: 0.003 | 780 | Present Invention |
| E | 0.16 | 1.2 | 1.5 | 0.010 | 0.003 | 0.20 | 0.022 | | 750 | Present Invention |
| F | 0.05 | 0.3 | 1.4 | 0.011 | 0.003 | 0.08 | 0.024 | Nb: 0.06, B: 0.004 | 830 | Present Invention |
| G | 0.19 | 0.5 | 2.3 | 0.010 | 0.002 | 0.24 | 0.023 | | 750 | Present Invention |
| H | 0.05 | 0.3 | 3.0 | 0.012 | 0.003 | 0.005 | 0.022 | | 780 | Comparative Example |
| I | 0.19 | 1.4 | 3.0 | 0.012 | 0.003 | 0.64 | 0.022 | | 720 | Comparative Example |
| J | 0.30 | 2.0 | 3.5 | 0.011 | 0.002 | 0.12 | 0.021 | Cr: 1.51 | 720 | Comparative Example |
| K | 0.12 | 0.6 | 1.4 | 0.015 | 0.003 | 0.25 | 0.020 | Nb: 0.08, Ni: 0.1, Ca: 0.002 | 790 | Present Invention |
| L | 0.10 | 0.5 | 1.5 | 0.009 | 0.002 | 0.16 | 0.035 | Cu: 0.08 | 760 | Present Invention |
| M | 0.12 | 0.4 | 1.3 | 0.008 | 0.002 | 0.16 | 0.040 | B: 0.0015 | 770 | Present Invention |

TABLE 2

| | | Hot Rolling | | | | | | | | Cooling Conditions | | |
|---|---|---|---|---|---|---|---|---|---|---|---|---|
| | | | Temperature range of | Reduction in low temperature range of dynamic recrystallization | | | | Temperature at which to complete | Thickness of | Time for which to | | Coiling |
| Steel Sheet Nos. | Steel Nos. | Slab Reheating Temperatures (° C.) | recrystallization (° C.) | Number of passes | Reduction % | Reduction at final pass % | Temperature difference ** ΔTd (° C.) | finish rolling (° C.) | finished steel sheet (mm) | initiate cooling (sec.) | Cooling rate (° C./sec) | Temperatures (° C.) |
| 1 | A | 1050 | 950–1050 | 4 | 10–15 | 25 | 60 | 830 | 2.3 | 0.3 | 40 | 580 |
| 2 | | 1250 | — | 0 | — | — | — | 850 | 2.3 | 2.3 | 30 | 600 |
| 3 | | 1000 | 850–1000 | 2 | 10–15 | 26 | 80 | 820 | 2.3 | 0.3 | 40 | 500 |
| 4 | B | 1050 | 850–1050 | 4 | 10–15 | 24 | 60 | 870 | 2.3 | 0.3 | 40 | 450 |
| 5 | | 1250 | — | 0 | — | — | — | 900 | 2.3 | 0.1 | 80 | 350 |

TABLE 2-continued

| Steel Sheet Nos. | Steel Nos. | Slab Reheating Temperatures (° C.) | Hot Rolling: Temperature range of recrystallization (° C.) | Reduction in low temperature range of dynamic recrystallization: Number of passes | Reduction % | Reduction at final pass % | Temperature difference ** ΔTd (° C.) | Temperature at which to complete finish rolling (° C.) | Thickness of finished steel sheet (mm) | Cooling Conditions: Time for which to initiate cooling (sec.) | Cooling rate (° C./sec) | Coiling Temperatures (° C.) |
|---|---|---|---|---|---|---|---|---|---|---|---|---|
| 6 | C | 1150 | 900–1100 | 4 | 10–15 | 25 | 60 | 850 | 2.3 | 0.3 | 40 | 420 |
| 7 | D | 1050 | 850–1000 | 4 | 10–15 | 28 | 80 | 870 | 2.3 | 0.3 | 40 | 400 |
| 8 | E | 950 | 850–950 | 3 | 10–15 | 24 | 60 | 830 | 2.3 | 0.3 | 40 | 600 |
| 9 | | 1000 | 850–1000 | * | — | 20 | 60 | 860 | 2.3 | 0.3 | 40 | 400 |
| 10 | F | 1050 | 900–1050 | 3 | 10–15 | 28 | 60 | 820 | 2.3 | 0.3 | 40 | 540 |
| 11 | G | 1000 | 820–1000 | 4 | 10–15 | 24 | 40 | 860 | 2.3 | 0.3 | 40 | 400 |
| 12 | H | 1050 | — | 0 | — | — | — | 820 | 2.3 | 0.2 | 60 | 400 |
| 13 | I | 1100 | 950–1100 | 4 | 10–15 | 20 | 60 | 850 | 2.3 | 2.5 | 50 | 440 |
| 14 | J | 1000 | 850–1000 | 4 | 10–15 | 20 | 80 | 900 | 2.3 | 0.3 | 40 | 580 |
| 15 | K | 1050 | 830–1040 | 4 | 10–15 | 25 | 40 | 830 | 2.3 | 0.3 | 40 | 540 |
| 16 | L | 1050 | 850–1000 | 4 | 5–12 | 20 | 60 | 820 | 3.5 | 0.3 | 40 | 550 |
| 17 | M | 1050 | 850–1000 | 4 | 12–18 | 30 | 60 | 830 | 1.8 | 0.3 | 40 | 550 |
| 18 | A | 1050 | 950–1050 | 4 | 10–15 | 10 | 60 | 850 | 2.3 | 0.5 | 30 | 500 |
| 19 | | 1050 | 950–1050 | 10 | 8–12 | 22 | 80 | 800 | 2.0 | 0.2 | 50 | 350 |
| 20 | | 1050 | 950–1050 | 4 | 25–30 | 30 | 60 | 830 | 2.0 | 0.5 | 40 | 400 |
| 21 | B | 1250 | — | 0 | — | — | — | 900 | 2.0 | 0.8 | 10 | 470 |

* Heating at 1000° C., reduction by 80% at 800° C., cooling to 600° C., heating to 850° C., reduction by 90% at 850° C.

** ΔTd = (inlet temperature at first rolling pass in temperature range of dynamic recrystallization) − (lowermost temperature in temperature range of dynamic recrystallization)

TABLE 3

| Steel Sheet Nos. | Steel Sheet Structures: Ferrite: Average grain size (μm) | Ferrite: Volume ratio (%) | Second-phase particles: Kind | Second-phase particles: Average particle size (μm) | Second-phase particles: Aspect ratio | Second-phase particles: Ratio of second phase spacing being not less than the particle size %* |
|---|---|---|---|---|---|---|
| 1 | 3.5 | 85 | P + B | 6.5 | 1.8 | 85 |
| 2 | 7.5 | 85 | P + B | 9.8 | 1.8 | 80 |
| 3 | 4.6 | 80 | B | 12.3 | 3.5 | 80 |
| 4 | 2.5 | 85 | M + γ | 5.5 | 1.7 | 88 |
| 5 | 3.8 | 80 | B + M | 7.7 | 1.9 | 25 |
| 6 | 2.3 | 80 | M + B + γ | 5.2 | 1.7 | 89 |
| 7 | 2.2 | 80 | B + M | 5.1 | 1.9 | 94 |
| 8 | 3.2 | 75 | P | 6.5 | 1.5 | 85 |
| 9 | 3.5 | 75 | M | 7.2 | 5.5 | 40 |
| 10 | 2.5 | 80 | P + B | 6.4 | 1.8 | 85 |
| 11 | 2.1 | 85 | M + γ | 4.5 | 1.8 | 80 |
| 12 | 7.8 | 80 | P + B | 12.3 | 4.8 | 25 |
| 13 | 3.0 | 70 | M + B + γ | 8.6 | 1.8 | 75 |
| 14 | 3.2 | 75 | B | 8.7 | 1.6 | 70 |
| 15 | 3.4 | 85 | P + B | 6.4 | 1.7 | 80 |
| 16 | 2.6 | 85 | M | 5.8 | 1.6 | 85 |
| 17 | 3.2 | 85 | P + B | 5.8 | 1.6 | 85 |
| 18 | 3.8 | 80 | P + B | 8.8 | 1.8 | 75 |
| 19 | 1.6 | 80 | B | 3.8 | 1.8 | 90 |
| 20 | 3.5 | 80 | P + B | 7.2 | 3.3 | 70 |
| 21 | 3.0 | 80 | B + M | 7.7 | 5.8 | 25 |

*Ratio of second phase in the particle, spacing of which with the closest particle being not less than the average particle size.

TABLE 3-continued

| Steel Sheet Nos. | Tensile Characteristics: Yield strength YS (MPa) | Tensile strength TS (MPa) | Elongation E1 (%) | Yield ratio YR (%) | TS*E1 (MPa − %) | Anisotropy ΔE1 |
|---|---|---|---|---|---|---|
| 1 | 452 | 556 | 39.7 | 79.5 | 22073 | −4.2 |
| 2 | 420 | 520 | 31.5 | 80.8 | 16380 | −6.5 |
| 3 | 505 | 650 | 21.0 | 77.7 | 13650 | −12.5 |
| 4 | 541 | 675 | 32.5 | 80.1 | 21938 | −4.1 |
| 5 | 545 | 680 | 28.3 | 80.1 | 19244 | −7.7 |
| 6 | 431 | 535 | 39.5 | 80.6 | 21133 | −3.8 |
| 7 | 485 | 584 | 36.8 | 83.0 | 21491 | −4.6 |
| 8 | 489 | 640 | 34.8 | 76.4 | 22272 | −4.0 |
| 9 | 547 | 640 | 27.0 | 85.5 | 17280 | −11.2 |
| 10 | 503 | 600 | 35.7 | 76.2 | 21420 | −4.3 |
| 11 | 629 | 763 | 28.3 | 82.4 | 21593 | −3.7 |
| 12 | 328 | 430 | 30.4 | 76.3 | 13072 | −8.5 |
| 13 | 596 | 665 | 25.4 | 89.6 | 16891 | −6.6 |
| 14 | 645 | 725 | 22.5 | 89.0 | 16313 | −9.3 |
| 15 | 491 | 655 | 32.8 | 75.0 | 21484 | −3.5 |
| 16 | 521 | 687 | 32.8 | 75.8 | 22534 | −4.0 |
| 17 | 489 | 650 | 35.1 | 75.2 | 22815 | −4.0 |
| 18 | 455 | 570 | 35.6 | 79.8 | 20292 | −6.6 |
| 19 | 670 | 720 | 31.8 | 93.1 | 22895 | −4.1 |
| 20 | 460 | 575 | 35.5 | 80.0 | 20412 | −6.8 |
| 21 | 555 | 670 | 27.9 | 82.8 | 18693 | −10.6 |

| Steel Sheet Nos. | Toughness Charpy transition temperature vTrs (° C.) | Remarks |
|---|---|---|
| 1 | <140 | Present Invention |
| 2 | −70 | Comparative Example |
| 3 | −40 | Comparative Example |
| 4 | <−140 | Present Invention |
| 5 | −90 | Comparative Example |
| 6 | <−140 | Present Invention |
| 7 | <−140 | Present Invention |
| 8 | <−140 | Present Invention |

TABLE 3-continued

| | | |
|---|---|---|
| 9 | −90 | Conventional Example |
| 10 | <−140 | Present Invention |
| 11 | <−140 | Present Invention |
| 12 | −70 | Comparative Example |
| 13 | −90 | Comparative Example |
| 14 | −90 | Comparative Example |
| 15 | <−140 | Present Invention |
| 16 | <−140 | Present Invention |
| 17 | <−140 | Present Invention |
| 18 | −90 | Comparative Example |
| 19 | <−140 | Comparative Example |
| 20 | −90 | Comparative Example |
| 21 | −70 | Comparative Example |

Each of the steel sheets representing the present invention was found to have an average grain size of ferrite of not less than 2 μm but less than 4 μm, an average particle size of second phase particles of not more than 8 μm, an aspect ratio of not more than 2.0, a ratio of not less than 80% in which the spacing of second phase particles present in closest proximity to each other is not less than the average particle size of second phase particles, an elongation of not less than 28%, a yield strength of not less than 400 MPa, and a TS×El product of not less than 20000 MPa·%. The anisotropy of elongation was low, i.e., less than 5% as an absolute value. The steel sheet was highly formable.

In contrast, comparative example steel sheet no. 2 was high in slab heating temperature, free of dynamic recrystallization, and had a large average grain size of ferrite, and hence, was too low in TS×El and greatly anisotropic. Comparative example steel sheet no. 3 was small in pass number at reduction in a dynamic recrystallization region, coarse in second phase particle, too high in aspect ratio (as high as 3.5) and greatly anisotropic in elongation. In comparative example steel sheet no. 5, fine graining was conducted only by cooling immediately after completion of the hot rolling. In comparative example steel sheet no. 21, large reductions were performed in a non-recrystallization region. Both of the steel sheets revealed second phase particles distributed in band-like form, too high an aspect ratio, too low a TS×El value and great anisotropy. Comparative example steel sheet no. 9 using reverse transformation revealed second phase particles distributed in band-like form, too high an aspect ratio, too low a TS×El value and great anisotropy. Comparative example steel sheet no. 12 was free of dynamic recrystallization and too large in particle size of second phase particle and too high in aspect ratio. Comparative example steel sheets nos. 13 and 14 outside the Ti or Mn content of the present invention showed a sharp deterioration in material quality. These comparative steel sheets were too high in ductility-brittleness transition temperature and unacceptable in toughness. In comparative example steel sheet no. 20, reductions were all more than 20%, but a second phase had too high an aspect ratio. In comparative example steel sheet no. 18, the final pass was conducted at the reduction of less than 13% in a low-temperature region of a dynamic recrystallization temperature, but a second phase could not be made fine. These steel sheets were greatly anisotropic in elongation. In comparative example steel sheet no. 19, many passes were performed in a low-temperature region of a dynamic recrystallization temperature, but the grain size was less than 2.0 μm, and YS and YR were too high though the other properties were generally good.

According to the present invention, a hot rolled steel sheet having an ultrafine grain structure is provided which is superior in mechanical characteristics, less anisotropic in mechanical characteristics, highly formable, easy to produce by the use of ordinary rolling apparatus and industrially significant.

What is claimed is:

1. A hot rolled steel sheet having an ultrafine grain structure, comprising ferrite as a main phase and a second phase, said second phase comprising at least one phase selected from the group consisting of pearlite, bainite, martensite and retained austenite, said ferrite having an average grain size of not less than 2 μm but less than 4 μm, said second phase having an average particle size of not more than 8 μm and in not less than 80% of the second phase, the spacing of the second phase particle with the closest second phase particle being not less than the second phase particle size.

2. The hot rolled steel sheet according to claim 1, wherein said second phase particles have an aspect ratio of not more than 2.0.

3. The hot rolled steel sheet according to claim 1, comprising: by weight percent, C: more than 0.01 to 0.3%;

Si: not more than 2.0%;

Mn: not more than 3.0%;

P: not more than 0.5%; and

Ti: 0.03 to 0.3%; and the balance Fe and incidental impurities.

4. The hot rolled steel sheet according to claim 1, comprising: by weight percent, C: more than 0.01 to 0.3%;

Si: not more than 2.0%;

Mn: not more than 3.0%;

P: not more than 0.5%;

Ti: 0.03 to 0.3%;

and at least one component selected from the group consisting of the components of at least one of the following Groups A to C;

Group A: Nb: not more than 0.3%, and V: not more than 0.3%;

Group B: Cu: not more than 1.0%, Mo: not more than 1.0%, Ni: not more than 1.0%, and Cr: not more than 1.0%; and Group C: Ca, REM and B in a total amount of not more than 0.005%; and the balance Fe and incidental impurities.

5. The hot rolled steel sheet according to claim 1, further comprising Al in an amount of not more than 0.2% by weight.

6. A hot rolled steel sheet having an ultrafine grain structure, comprising ferrite as a main phase and a second phase, said ferrite having an average grain size of not less than 2 μm but less than 4 μm, said second phase having an average particle size of not more than 8 μm and in not less than 80% of the second phase, the spacing of the second phase particle with the closest second phase particle being not less than the second phase particle size, wherein the hot rolled steel sheet comprising by weight percent:

C: more than 0.01 to 0.3%;

Si: not more than 2.0%;

Mn: not more than 3.0%;

P: not more than 0.5%; and

Ti: 0.03 to 0.3%; and the balance Fe and incidental impurities.

7. The hot rolled steel sheet according to claim 6, wherein said second phase particles have an aspect ratio of not more than 2.0.

8. The hot rolled steel sheet according to claim 6, wherein said second phase comprises at least one phase selected from the group consisting of pearlite, bainite, martensite and retained austenite.

9. The hot rolled steel sheet according to claim 6, further comprising by weight percent:

at least one component selected from the group consisting of the components of at least one of the following Groups A to C:

Group A: Nb: not more than 0.3% and V: not more than 0.3%;

Group B: Cu: not more than 1.0%, Mo: not more than 1.0%;

Ni: not more than 1.0%, and Cr: not more than 1.0%; and

Group C: Ca, REM and B in a total amount of not more than 0.005%; and the balance Fe and incidental impurities.

10. The hot rolled steel sheet according to claim 6, further comprising Al in an amount of not more than 0.2% by weight.

* * * * *